US010505271B2

(12) United States Patent
Constance et al.

(10) Patent No.: US 10,505,271 B2
(45) Date of Patent: Dec. 10, 2019

(54) SMALL CELL POLE ANTENNA CONFIGURATION

(71) Applicant: Comptek Technologies, LLC, Boulder, CO (US)

(72) Inventors: Michael Constance, Parker, CO (US); James D. Lockwood, Boulder, CO (US); Matthew Chase, Windsor, CO (US); Steve Mustaro, Longmont, CO (US); Matthew Fleck, Denver, CO (US)

(73) Assignee: COMPTEK TECHNOLOGIES, LLC, Boulder, CO (US)

( * ) Notice: Subject to any disclaimer, the term of this patent is extended or adjusted under 35 U.S.C. 154(b) by 0 days.

(21) Appl. No.: 15/933,042

(22) Filed: Mar. 22, 2018

(65) Prior Publication Data

US 2018/0351245 A1 Dec. 6, 2018

Related U.S. Application Data

(60) Provisional application No. 62/475,195, filed on Mar. 22, 2017.

(51) Int. Cl.

| | |
|---|---|
| ***H01Q 1/44*** | (2006.01) |
| ***H01Q 1/12*** | (2006.01) |
| ***H01Q 1/24*** | (2006.01) |
| ***H01Q 21/20*** | (2006.01) |

(52) U.S. Cl.
CPC ..... *H01Q 1/44* (2013.01); *H01Q 1/1207* (2013.01); *H01Q 1/1242* (2013.01); *H01Q 1/1264* (2013.01); *H01Q 1/245* (2013.01); *H01Q 21/205* (2013.01)

(58) Field of Classification Search
CPC .. H01Q 1/44; H01Q 1/12; H01Q 1/24; H01Q 21/20
USPC ..... 343/721
See application file for complete search history.

(56) References Cited

U.S. PATENT DOCUMENTS

2010/0231469 A1* 9/2010 Kim ..... H01Q 1/246 343/721
2015/0349399 A1* 12/2015 Lasier ..... H01Q 1/06 343/721

* cited by examiner

*Primary Examiner* — Andrea Lindgren Baltzell
(74) *Attorney, Agent, or Firm* — Marsh Fischmann & Breyfogle LLP; Russell T. Manning

(57) ABSTRACT

The present disclosure is directed to small cell poles that are configured for use in urban environments. In various implementations, the small cell poles have a configuration similar to existing utility poles, which minimizes their aesthetic obtrusiveness. In order to reduce the size of an antenna structure of such a small cell pole, implementations utilizes antennas that are vertically stacked, which permits an antenna structure of a small cell pole to have a reduced width. In various implementations, one or more antennas are vertically stacked within a spatial envelope of a pole. For instance, one or more antennas may be disposed within the interior of a pole such that a resulting cell ole is similar in appearance to a utility pole.

18 Claims, 12 Drawing Sheets

SMALL CELL POLE ANTENNA CONFIGURATION

CROSS REFERENCE

The present application claims the benefit of the filing date of U.S. Provisional Application No. 62/475,195 filed on Mar. 22, 2017, the entire contents of which is incorporated herein by reference.

FIELD

The present disclosure is directed to cell poles for providing coverage for local service areas. More specifically, the present disclosure is directed to small cell access cell poles having a reduced size to more aesthetically match their environment.

BACKGROUND

In wireless communication networks, high powered base stations (e.g., towers supporting antennas) commonly provide serve service to wireless user devices. Each base station is capable of serving wireless user devices in a coverage area that is primarily determined by the power of the signal it can transmit. Frequently, high powered base stations are located in a grid pattern and these base stations typically mount various antennas at an elevated location, such as on a tower. For example, such base stations may include a single omnidirectional antenna, two 90 degree sector antennas, or three 120 degree sector antennas to provide 360 degree coverage. In any arrangement, radio wave propagation from the base station is affected in unpredictable ways by objects in the environment, such as trees, buildings and so forth. Radio signals will often follow the roadways in urban canyons, bouncing back and forth between buildings, and not following a direct line between the emitter and receiver. Such interference affects the data transfer rate of such large base stations.

To improve wireless access, providers are moving toward smaller stations that provide coverage for a more limited geography. That is, to augment the coverage of the wireless network, wireless transceiver devices/stations (e.g., antennas) with relatively small coverage areas (and serving capacities) are deployed. Depending on their coverage area and serving capacities, these wireless transceiver devices are referred to as "femto" cells or "pico" cells, or more generally, small cell access point devices or small cell poles. For simplicity and generality, the term "small cell pole" is used herein to refer to a wireless transceiver device that is configured to serve wireless user devices over relatively small coverage areas and with generally less capacity as compared to a "macro" base station that is configured to serve a relatively large coverage area ("macro cell"). Such small cell poles are now being deployed to provide coverage for individual city blocks. Along these lines, such small cell poles are commonly deployed on sidewalks and other rights of way within urban environments.

The ever increasing use of RF bandwidth or 'mobile data' requires a corresponding increase in the number of small cell poles located within urban environments. By way of example, proposed 5G wireless networks promise greatly improved network speeds and are currently being planned and implemented. However, such networks typically require shorter RF transmission distances compared to existing networks and will require more dense networks of access points/small cell poles to handle data traffic. In the wireless industry, this is referred to as densification. Residents of many communities have objected to such densification in their neighborhoods often due to the aesthetic concerns of such small cell poles.

SUMMARY

The present disclosure is directed to small cell poles that are configured for use in urban environments. In various implementations, the small cell poles have a configurations similar to existing utility poles, which minimizes their aesthetic obtrusiveness. In order to reduce the size of an antenna structure of such a small cell pole, implementations utilize antennas that are vertically stacked, which permits an antenna structure of a small cell pole to have a reduced cross-dimension or width. In various implementations, one or more antennas are vertically stacked within a spatial envelope of a pole. For instance, one or more antennas may be disposed within the interior of a pole such that a resulting cell pole is similar in appearance to a utility pole.

In one implementation, an antenna enclosure is provided. The antenna enclosure or small cell pole includes a pole having a lower end configured for attachment relative to a ground surface. An upper end of the pole is configured to support one or more antenna support sections. A periphery of the upper end of the pole and/or a sidewall periphery of the pole defines a projection of the pole above its top end, where the projection is disposed around the longitudinal axis of the pole. This projection generally defines a spatial envelope of the pole. A first antenna support section is connectable to the top end of the pole. The first antenna support section is an elongated member having an upper end and a lower end that are spaced to define an interior volume there between. At least the first support structure extends between the upper end and lower end. The support structure is offset from the longitudinal axis of the pole to increase the interior volume of the antenna support section. The upper end, lower end and support structure of the first antenna support section are configured to be disposed within the projection of the pole when connected to the pole. The antenna support section may house one or more antennas. Typically, these antennas are disposed within an interior of the antenna support section such that they remain within the projection of the pole. The pole may include a second antenna support section connected to the first support structure. The second antenna support section may be configured similarly to the first antenna support section and is likewise disposed within the projection of the pole. The second antenna support section is supported by the first antenna support section. Additional antenna support sections may be incorporated above the second antenna support section. In this regard, the antenna support sections are modular sections allowing additional antenna support sections may be added depending on needs of particular small cell pole. In various implementations, a radio-frequency transparent sleeve is applied to the antenna support sections.

In one implementation, the antenna support sections are formed of annular end plates, which need not be circular (e.g., octagonal). The annular end plates include an interior aperture that permits the passage of cables through the antenna support sections. In one arrangement, the annular in plates include a plurality of apertures around their periphery to allow for connection to the pole, adjacent antenna support section or other structures. The plurality of apertures permit adjacent antenna support sections to be rotated relative to one another such that supported antennas may be directed in different directions. In one implementation, the apertures are elongated to permit additional directional adjustment of antennas supported by the antenna support sections.

In one implementation, the support structure extending between the upper and lower ends of the antenna support section is formed of one or more struts. In such an implementation, the strut(s) may be substantially aligned with the longitudinal axis of the pole. However, the strut(s) is offset from the longitudinal axis as noted above. In such an implementation, a side of the antenna support section may remain substantially open to permit an antenna to emit a beam patterns free of obstruction. In another implementation the support structure extending between the upper and lower ends of the antenna support section is a peripheral sidewall. In such an implementation, the peripheral sidewall may have a window along its length and around a portion of its periphery to permit an antenna to emit a beam pattern free of obstruction.

In further implementations, the modular antenna support sections may be incorporated into an antenna structure that is larger than the diameter of a supporting pole. While not fitting within the projection of the pole, the vertical stacking of the antenna support structures permits a reduced cross dimensional size of the antenna structure.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

The present disclosure is directed to small cell poles that are configured for use in urban environments. In various embodiments, the small cell poles have a configurations that minimizes their aesthetic obtrusiveness making them more suited for use in urban environments. Various embodiments of the presented inventions are related to the recognition by the inventors that small cell poles may be incorporated into configurations that are similar to utility poles currently existing in urban environments. By way of example, most streets already have a number of light poles and/or power poles. Accordingly, by mimicking the configuration of such existing poles, the obtrusiveness of such small cell poles may be reduced. Further, it has been recognized that most current cell poles utilize multiple sector antennas that provide coverage for different arc portions or azimuth directions of a 360° coverage cell. For instance, such cell poles often include three 120° sector antennas, which provide 360° coverage for the cell site. Most commonly, such sector antennas are arranged at a common height above the surface/ground in an elevated antenna structure. Due to the size of the individual sector antennas, the resulting antenna structure of the cell pole typically is significantly wider than a pole supporting the antenna structure, which results in an overall cell pole structure that does not blend in with its surroundings. The inventors have further recognized that the space within the interior of a pole may, in some instances, be utilized to house such antennas. Further, the inventors have recognized that by vertically stacking multiple sector antennas, 360° coverage may be provided from a cell pole that has dimensions similar to a light pole or other utility pole. Yet further, the inventors have recognized that by making each antenna support of such vertically stacked antennas as a separate section, a resulting cell pole may be modular, which may allow adding or removing antennas as needed.

Figure 1:
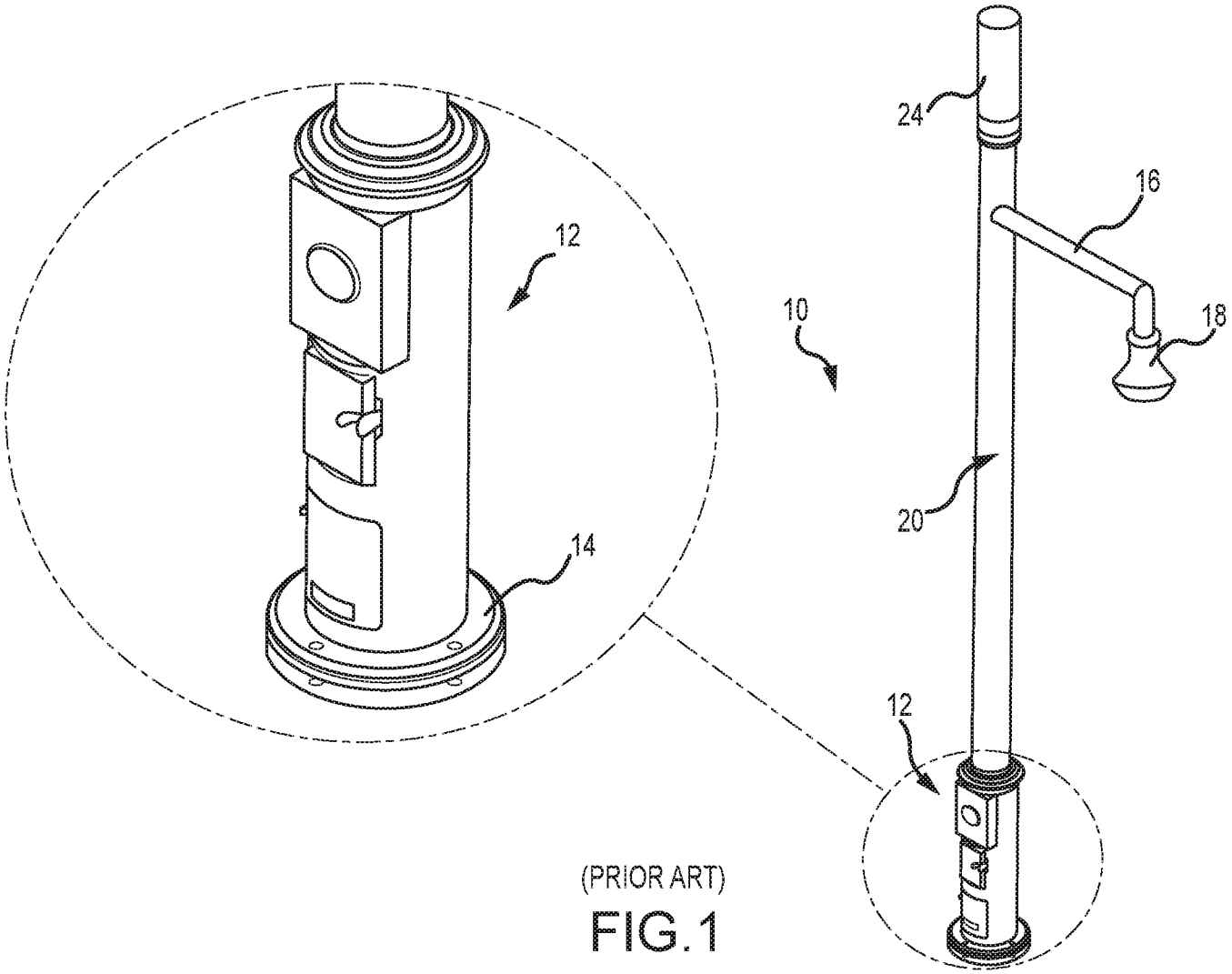
(PRIOR ART) FIG. 1
FIG. 1 illustrates one embodiment of a prior art small cell pole.

FIG. 1 illustrates one embodiment of a prior art small cell pole 10. Various features of this small cell pole are disclosed in co-owned U.S. Patent Publication No. 2017/0279187, the entire contents of which are incorporated herein by reference. As shown, the cell pole includes a lower equipment housing 12 that includes an inner cavity (e.g., interior) configured to house cell control equipment. The equipment housing 12 has a lower flange 14 used to mount the housing to a surface (e.g., ground). Other installation methods are possible. Access panels and/or doors may be mounted to the equipment housing 12 to enclose equipment from the elements, while providing selective access, when desired, to modify, regulate, change out, or otherwise access the equipment. The housing may include locks, hinges, access doors, vents for passive radiant cooling, and/or viewing ports. Cable ports and other features may be formed therein during manufacture.

Fasteners, such as threaded posts or bolts, are formed on an upper surface (e.g., flange; not shown) of the equipment housing 12 to facilitate attachment of a pole 20, which may support one or more small cell antenna structures 24. As shown, the cell pole 10 has a two-part design: the lower equipment housing 12 and the pole 20. The two-part construction allows for easier construction and implementation during set-up. That is, the equipment housing 12 can be installed separately from the pole 20 and/or antenna structure 24. Additionally, any equipment contained in the equipment housing may be installed at a later time. The present embodiment also illustrates a light mast or arm 16 attached to an upper portion of the pole 20. The illustrated light mast 16 supports a street light 18.

As set forth in U.S. Patent Publication No. 2017/0279187, the interior of the equipment housing 12 may open into the generally hollow interior of the pole 20. This allows passage of cables from the equipment housing(s) into the center of the pole to, for example, one or more antennas and/or lights. The pole is generally intended to be located in an urban area while assimilating with its urban surroundings. That is, the cell pole may simulate the look and feel of a street light pole to prevent distraction from the natural urban setting.

Figure 2A:
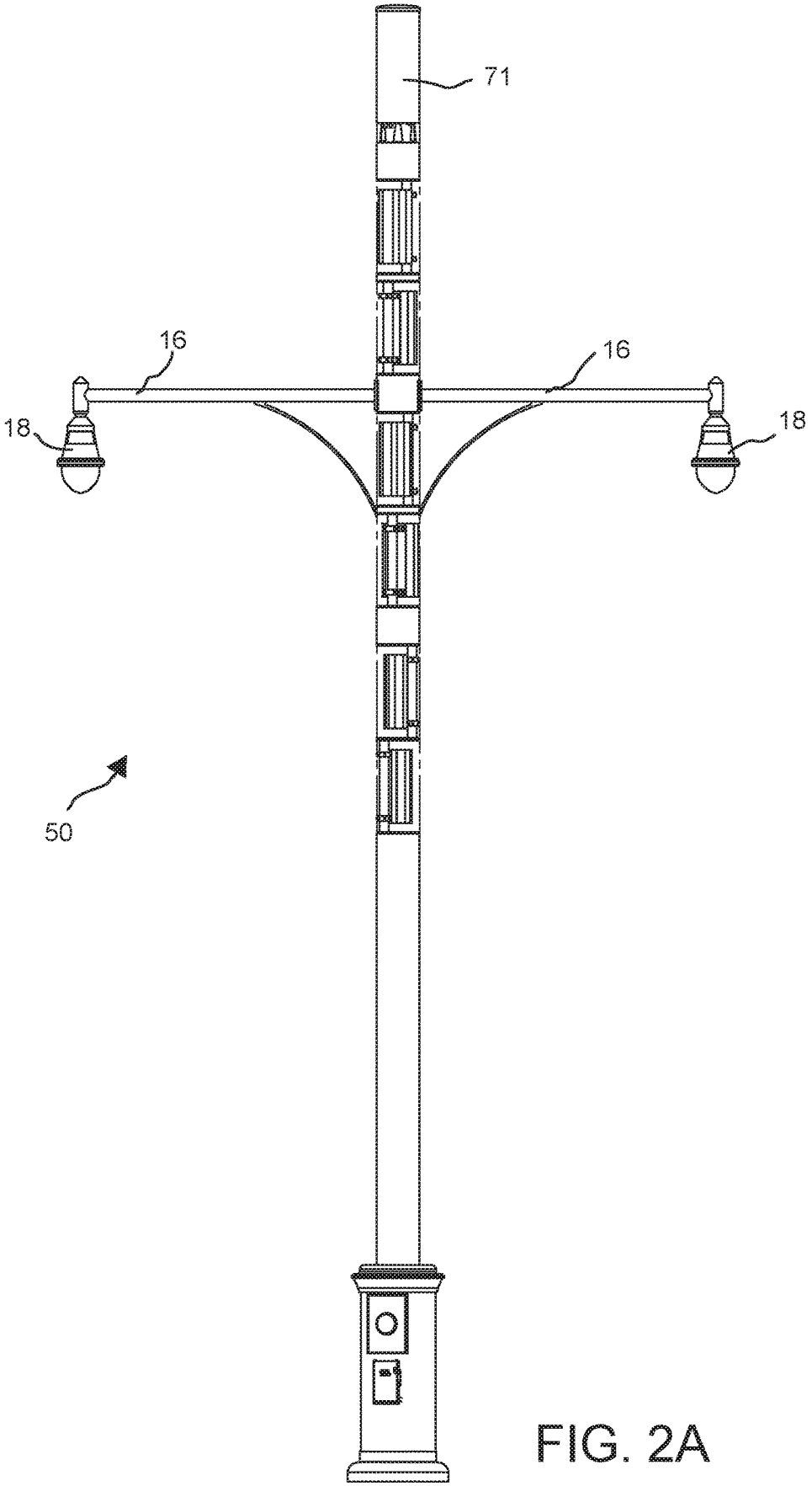
FIGS. 2A and 2B illustrate one embodiment of a small cell pole having vertical modular antenna sections.
Figure 2B:
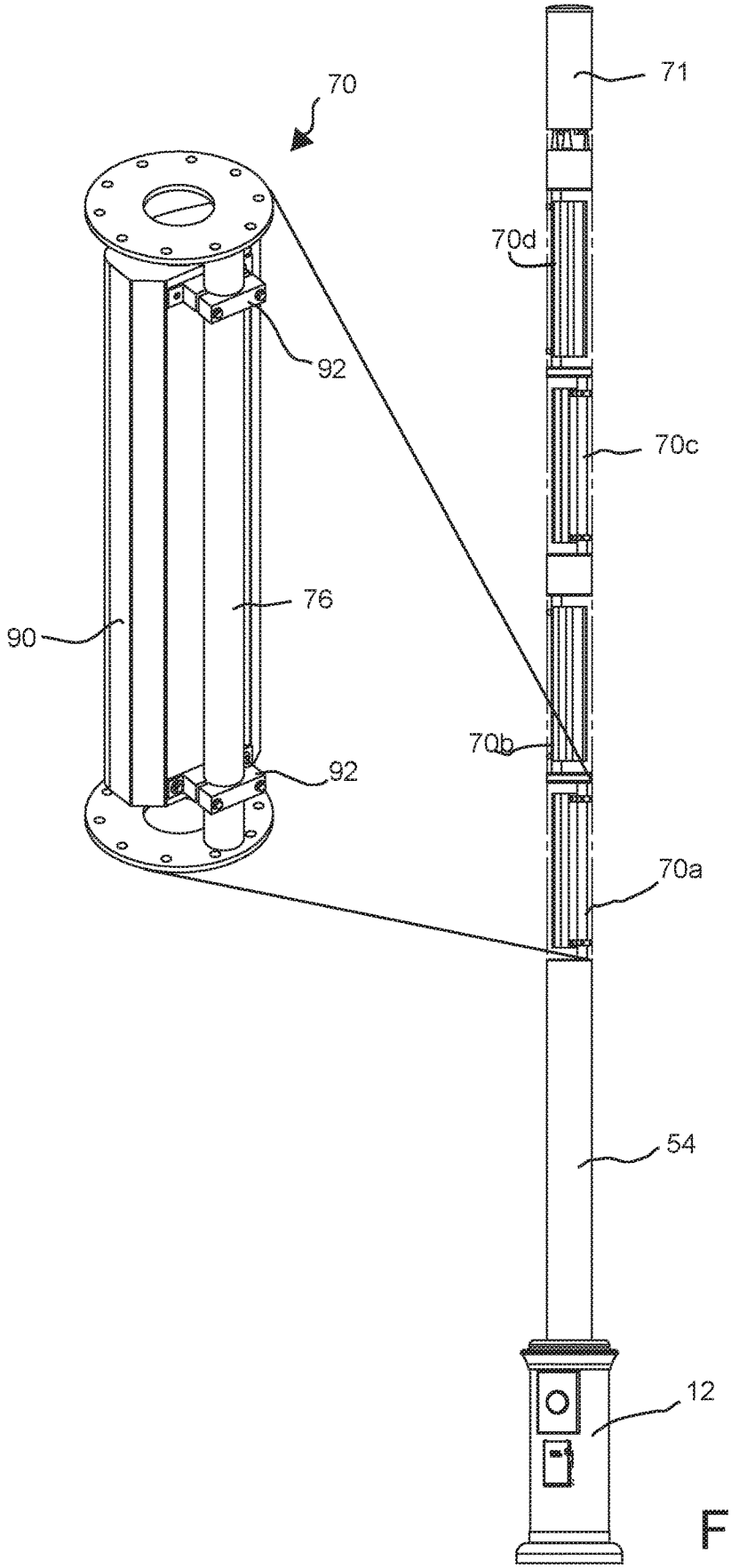

As noted above, the inventors have recognized that the space within the interior of a pole may, in some instances, be utilized to house one or more antennas. That is, the inventors have recognized that the interior space of the pole is currently not utilized and provides a space that could house one or more antennas such that those antennas are disposed within a spatial envelope of the pole. FIGS. 2A and 2B illustrate one embodiment of a small cell pole 50 that houses a plurality of vertically stacked antenna elements within the spatial envelope of the cell pole 50. More specifically, FIG. 2A illustrates a side view of the cell pole 50 having first and second light masts 16 and lights 18. FIG. 2B illustrates the same cell pole with the light masts removed and with a magnified view of an individual antenna support section 70. The illustrated embodiment of the cell pole 50 includes a lower equipment housing 12, a support pole section or 'monopole' 54, four antenna support structures/sections 70*a*-70*d* (hereafter 70 unless specifically referenced) and an upper housing 71. The upper housing may be a decorative cap, a light or encase, for example, an antenna (e.g., Bluetooth, WiFi, omnidirectional cell etc.). Though illustrated as including the lower equipment housing 12, it will be appreciated that not all embodiments of the cell pole 50 require such a lower equipment housing. Along these lines, the lower end of the monopole 54 may be configured for attachment to a ground surface and/or a subterranean equipment vault.

As illustrated in FIG. 2B, a lower end of the monopole 54 is connected to the equipment housing 12. An upper end of the monopole 54 is connected to and supports the lower end of the first antenna support section 70*a*. An upper end of the first antenna support section 70*a* is connected to and supports the lower end of the second antenna support section 70*b*. Likewise, the lower end of each subsequent antenna section is supported by the upper end of the antenna section disposed directly below. As shown, the use of the individual antenna sections allows the cell pole 50 to be a modular system that allows for adding additional antenna sections as desired. For instance, different wireless providers may utilize different support sections and/or different support sections may provide antenna coverage for different azimuth directions. In the illustrated embodiment, each antenna support section 70 supports a single panel antenna 90. However, the exact configuration of the antenna(s) may be varied.

Figure 2C:
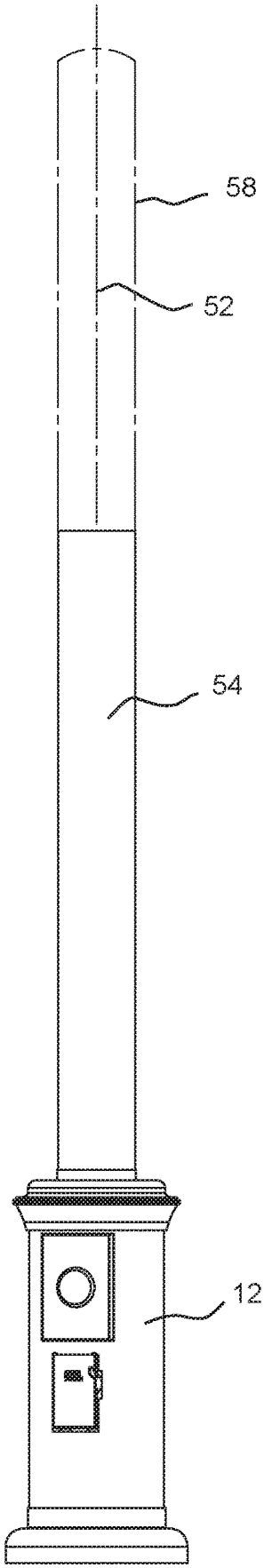
FIG. 2C illustrates a spatial envelope projection of the small cell pole of FIGS. 2A and 2B.

In the present embodiment, each antenna support section 70 supports an antenna such that the antenna support section 70 and its antenna is disposed within the spatial envelope or projection of the pole 54. FIG. 2C illustrates the spatial envelope of the monopole 54. As shown, the outer periphery of the monopole (e.g., pole sidewall) defines a spatial envelope of the pole. When projected beyond the upper end of the monopole 54, the spatial envelope defines a projection 58 of the monopole. In the illustrated embodiment, the monopole 54 is cylindrical and the projection 58 beyond the upper end of the monopole 54 is a corresponding cylinder disposed about a central or longitudinal axis 52 of the monopole 54. However, it will be appreciated that the monopole may have different cross-sectional shapes (e.g., square, rectangular, hexagonal, octagonal, etc.). Accordingly, the projection 58 may have a corresponding cross-sectional shape. Further, the monopole may be tapered between its lower end and its upper end (e.g., generally conical) or have another non-uniform exterior shape. In the former regard, the projection may terminate in a point at a location above the upper end of the monopole. In the latter regard, the projection may take the cross-sectional shape of the top end of the monopole. In any arrangement, the antenna support sections 70 and their supported antennas may be configured such that they are disposed within the projection of the monopole 54. Further, the cross-sectional shape of the antenna support sections may correspond to the cross-sectional shape of the monopole.

Figure 3:
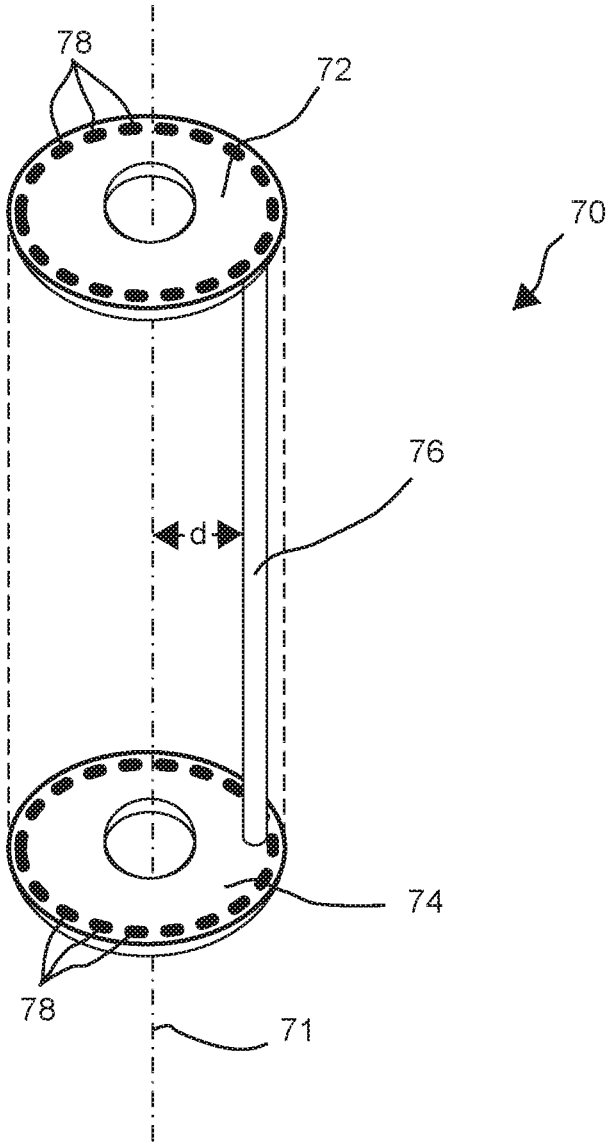

FIGS. 2B and 3 illustrate one embodiment of the antenna support section 70. In this embodiment, the antenna support section 70 includes an upper end and a lower end, which are formed as an upper annular plate 72 and a lower annular plate 74, respectively. The two plates 72, 74 each include a central aperture, which permit the extension of wiring or cabling (not shown) through the antenna support section, when the small cell pole is assembled. As shown the two plates 72, 74 are disposed in a spaced relationship to define an interior volume 75 between the plates as shown by the phantom lines in FIG. 3. This interior volume 75 is sized to house an antenna therein.

A structural support or strut 76 extends between the upper plate 72 and lower plate 74. The ends of the strut 76 are fixedly attached (e.g., welded, bolted, integrally formed, etc.) to each plate. As will be appreciated, when utilized in the assembled cell pole, the antenna support section 70 becomes a structural member that supports structures attached to its upper end such as, for example, upper antenna support section, lights etc. Thus, the antenna support section must support loads such as compressive loads and/or moment loads (e.g., wind loading) applied by supported structures or elements. Accordingly, the strut 76 may include multiple struts (not shown) that extend between the plates and/or various bracing with the plates to provide adequate structural rigidity. Further, it will be noted that when multiple antenna support sections are provided in a single cell pole, the configuration of adjacent antenna support sections may be different. For instance, a lower antenna support section may have thicker plates and/or struts (e.g., to support greater loads) while upper antenna support sections may have thinner plates and/or struts and/or be made of different materials. For instance, the lower antenna support section may be made of steel while upper antenna support sections may be made of a lighter materials such as aluminum or composites.

As shown, the structural support or strut 76 is offset from the center or longitudinal axis 71 of the antenna support section 70. Typically, the longitudinal axis 71 is aligned with the longitudinal axis of the monopole when the cell pole is assembled, though this is not a strict requirement. The offset 'd' between the strut 76 and the longitudinal axis of the monopole/cell pole increases the interior volume 75 of the antenna support section 70. That is, an antenna support section having a central support strut (e.g., aligned with the longitudinal axis of the antenna support section and/or monopole) would significantly limit the size of an antenna element may be disposed within the interior volume 75. Further, it is desirable that any struts or support members be positioned such that a side portion of the antenna support section remain substantially open. That is, as shown in FIG. 2B, when an antenna 90 is disposed within the antenna support section 70, it is desirable that the active portion of the antenna be directed to an open side surface of the antenna support section to reduce or eliminate interference. Stated otherwise, it is desirable that a radiation beam/pattern of the antenna 90 be emitted out of the antenna support section free of interference caused by structures disposed in front of the antenna.

In the illustrated embodiment, the strut 76 also forms an antenna mount, though separate antenna mounts are possible and considered within the scope of the present disclosure. As shown in FIG. 2B, the antenna has rearward brackets 92 that are configured to mount about the strut 76, which in the present embodiment is a substantially cylindrical element. These brackets 92 may be tightened around the strut 76 when the antenna 90 is in a desired position. This allows for fine-tuning the directionality of the antenna.

To further permit fine directing of antennas supported by the illustrated antenna support section 70, the upper and lower plates 72, 74 each include a plurality of apertures 78 disposed about their periphery. These apertures 78 allow for connecting each antenna support section 70 to structures above and below the antenna support section 70 utilizing one or more fasteners (e.g., bolts). The apertures 78 allow for rotating each antenna support section relative to one or more adjacent antenna support sections to align two or more adjacent antennas in different azimuth directions. Further, the apertures 78 may be elongated. The elongation of the apertures 78 permits additional adjustment between two adjacent structures prior to affixing their relative positions, for example, by tightening one or more fasteners. Accordingly, this additional adjustment provides fine-tuning of the direction of an antenna supported by the antenna support section 70.

Referring again to FIG. 2B, it is noted that each antenna support section 70*a*-70*d* is rotated relative to any adjacent antenna support section. By rotating each individual antenna support section relative to an adjacent support section, the individual antenna elements supported by these antenna support sections may be directed in different azimuth directions. Accordingly, the support struts 76 of adjacent antenna support sections are non-aligned. This allows a set of vertically stacked antennas to provide 360 degree coverage from a small cell pole while maintaining a slim profile (e.g., within the projection of the monopole) that is similar to existing utility poles. Of note, the fasteners and/or brackets attaching the antennas to the antenna support sections may allow for adjusting the elevation (e.g., tilt) of the antennas and, hence, their beam patterns.

Figure 2D:
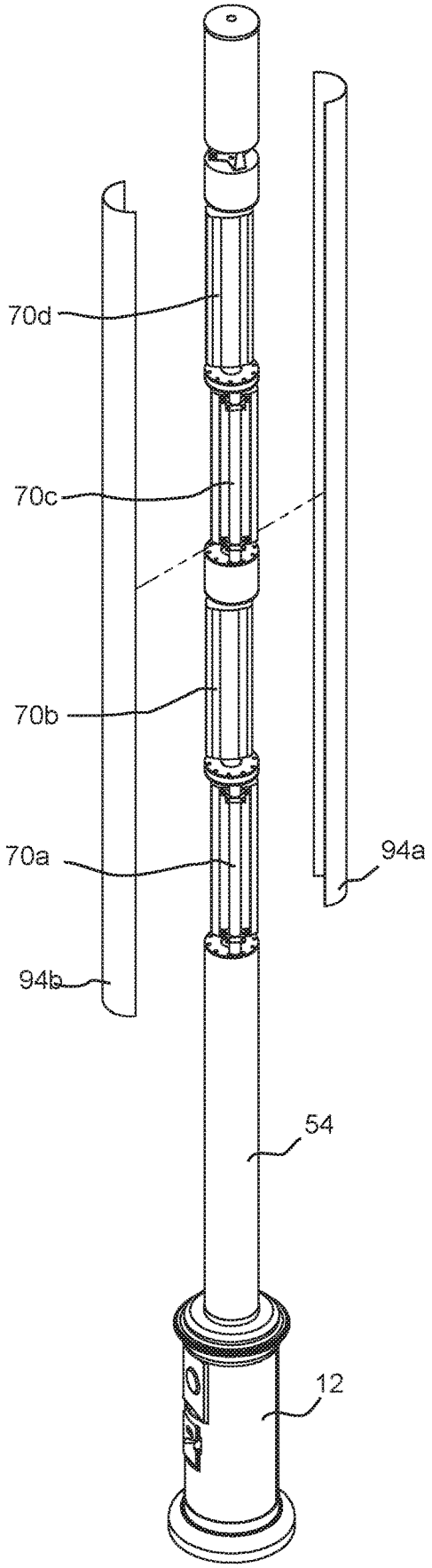
FIG. 2D illustrates a sleeve applied to the outside of the small cell pole of FIG. 3 illustrates one embodiment of an antenna support section.

Once the cell pole 50 is assembled, it may be desirable to cover the antenna support sections 70 and antennas 90 to provide a finished look and to allow the resulting small cell pole to better blend in with its surroundings. As shown in FIG. 2D, a sleeve may be applied to cover the generally open side surfaces of the antenna support sections 70. As illustrated, the sleeve is formed of first and second sleeve members 94*a*, 94*b* (hereafter sleeve 94) that, in the present embodiment, are half cylindrical elements, which may be affixed to the outside surface of the pole 50. Though shown as a cylindrical sleeve, it will be appreciated that the sleeve may have any cross-sectional shape to, for example, match a cross-sectional shape of the pole 50. Further, though shown as utilizing a two-piece sleeve, it will be appreciated that the sleeve may be a single piece and/or that each antenna support section may have a separate sleeve. In any arrangement, it may be desirable that the sleeve member is substantially transparent to radiofrequency (RF) waves. Such RF transparent materials include, without limitation, fiber glasses, polymers and/or fabrics. Typically, the sleeve will be a thin element that readily permits transmission of RF signals. The sleeve 94 may, but need not be disposed within the projection of the monopole 54. That is, the sleeve may be disposed outside of the projection. However, due to its generally thin structure, the disposition of the sleeve on the pole 50 outside of its projection does not affect the overall aesthetic appearance of the pole.

Figure 4A:
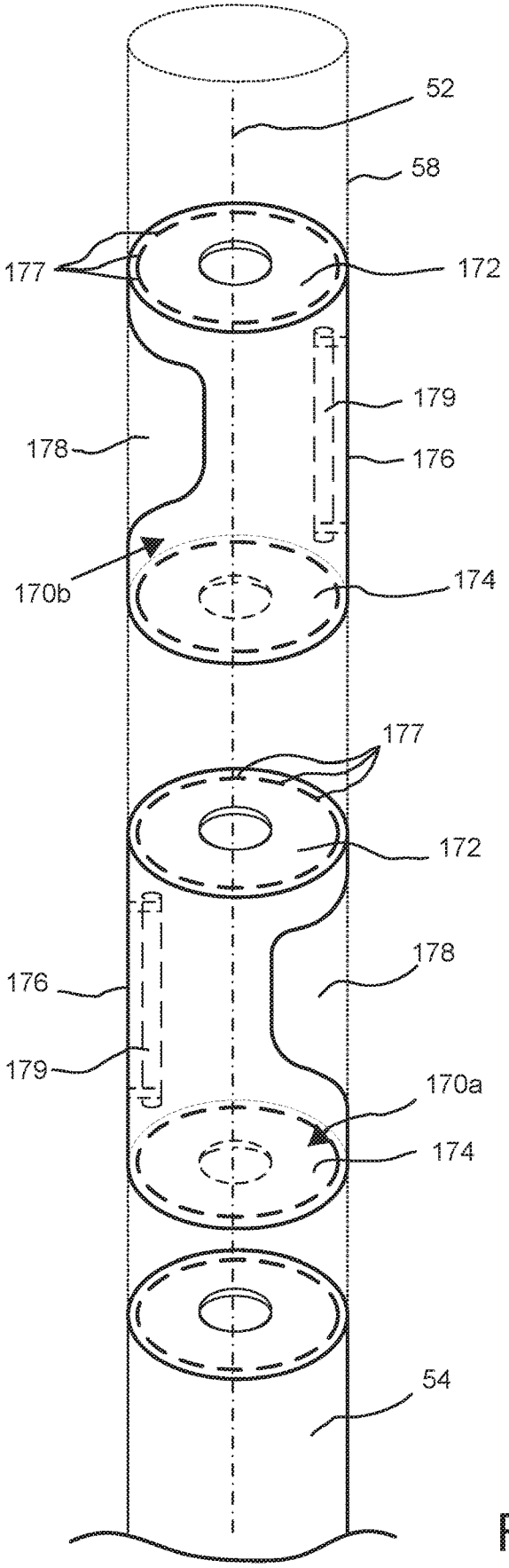
FIGS. 4A and 4B illustrate another embodiment of antenna support section.
Figure 4B:
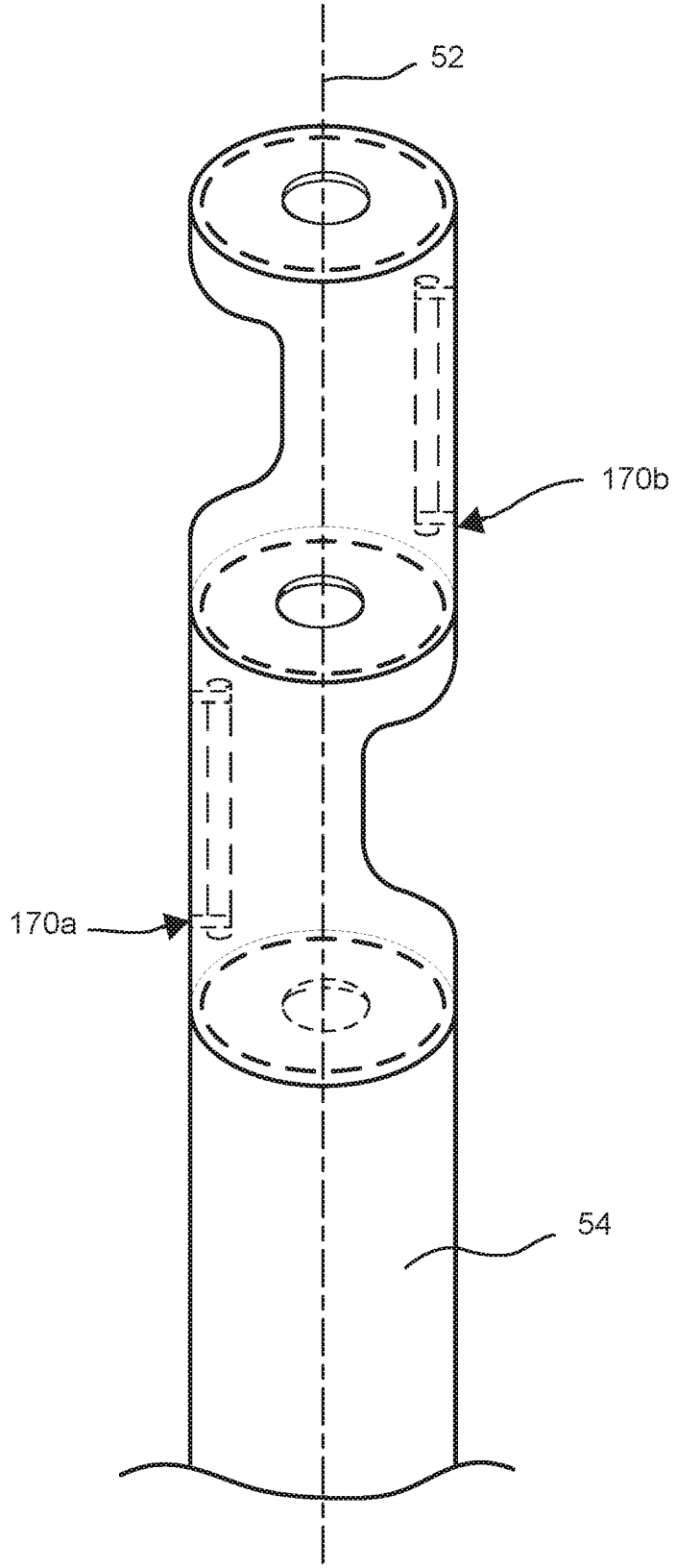

FIGS. 4A and 4B illustrate another embodiment of an antenna support section configured to support antennas in a vertical configuration relative to, for example, a monopole of the cell pole. As shown, the antenna support sections 170*a*, 170*b* (hereafter 170 unless specifically referenced) are again configured for disposition within a projection 58 of the top end and/or periphery of a support pole or monopole 54 of a cell pole system. The antenna support section 170 again includes an upper end and a lower and formed from first and second annular plates 172, 174, which are spaced to define an interior volume of the antenna support section 170. The annular plates may include a plurality of apertures 177, which may be elongated as discussed above. However, in contrast to the previously described antenna support sections, the present embodiment of the antenna support section 170 includes a sidewall 176 (e.g., substantially annular sidewall) that extends between the annular plates 172, 174. The sidewall act as a structural support and is again offset from the longitudinal axis of the support section to increase the interior volume of the section. As illustrated, the present embodiment of the sidewall 176 is substantially cylindrical and sized to fit within the projection 58 of the monopole 54. However, it will be appreciated that if the top end of the monopole has a different cross-sectional configuration, though the sidewall may be correspondingly configured. For instance, if the top end of the monopole 54 has a hexagonal cross-sectional shape, the sidewall may have a corresponding hexagonal cross-sectional shape. The use of the cylindrical sidewall 176 as a structural support between the ends of the antenna support section 170 may increase the structural integrity of the antenna support section while providing an open interior for housing one or more antennas.

In order to permit an antenna (not shown) disposed within the interior of the antenna support section 170 to provide communications substantially free of interference, the sidewall 176 includes an antenna opening or window 178. The window 178 extends through a portion of the height and about radial length or arc of the sidewall 176. The exact size of the window may be modified depending on an antenna that will be supported by the support section. In any case, the window 178 provides an opening that allows an antenna positioned within the interior of the antenna support section to be exposed to the environment substantially free of interference. Each antenna support section 176 may include an interior mount 179 that allows for attaching an antenna (not shown) within the interior of the antenna support section. In one embodiment, the interior mount 179 is formed as a cylindrical element to permit rotation of the antenna element when installed. Once assembled, a sleeve may be positioned over the antenna support sections and/or substantially RF transparent covers may be provided for the windows in the antenna support sections.

Figure 5A:
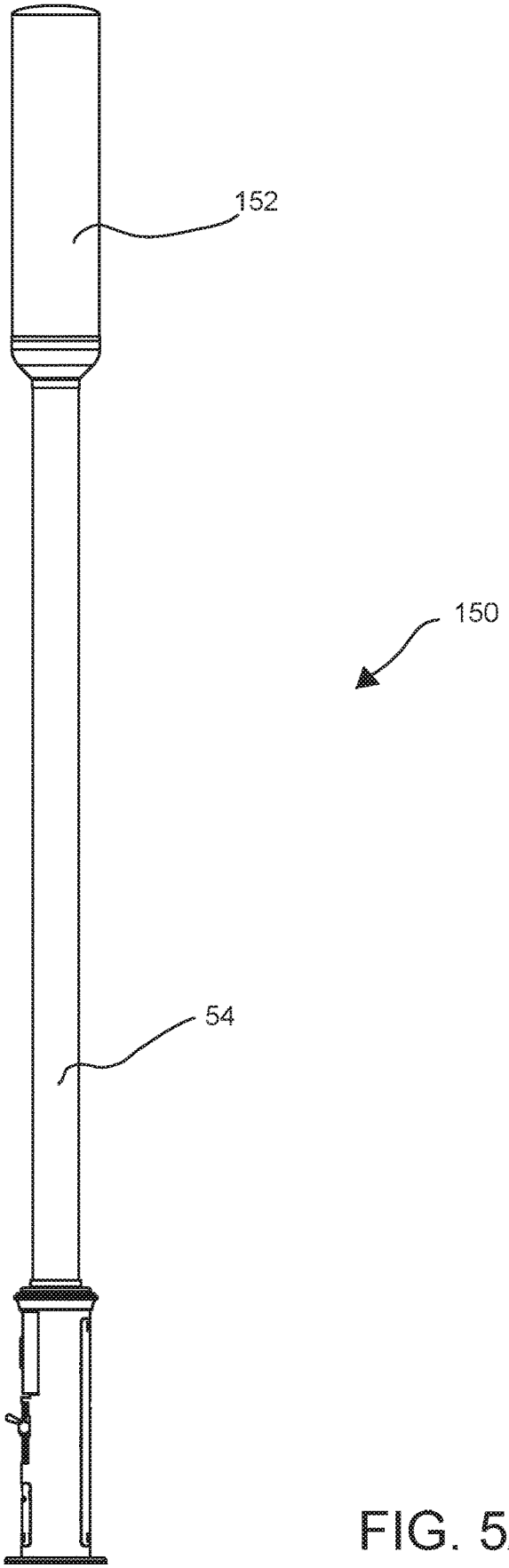
FIG. 5A illustrates another embodiment of a small cell pole.
Figure 5B:
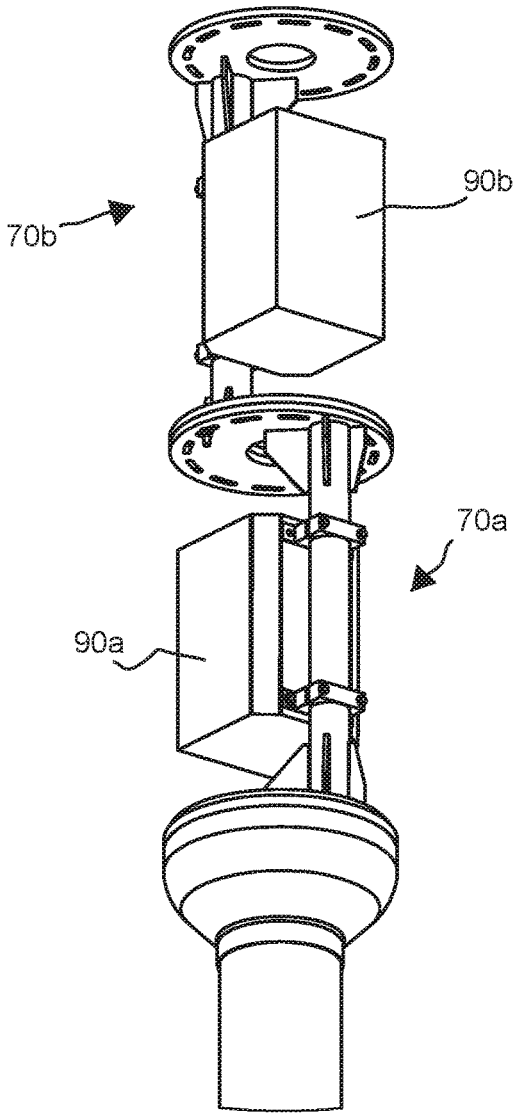
FIGS. 5B and 5C illustrate an antenna section of the small cell pole of FIG. 5A.
Figure 5C:
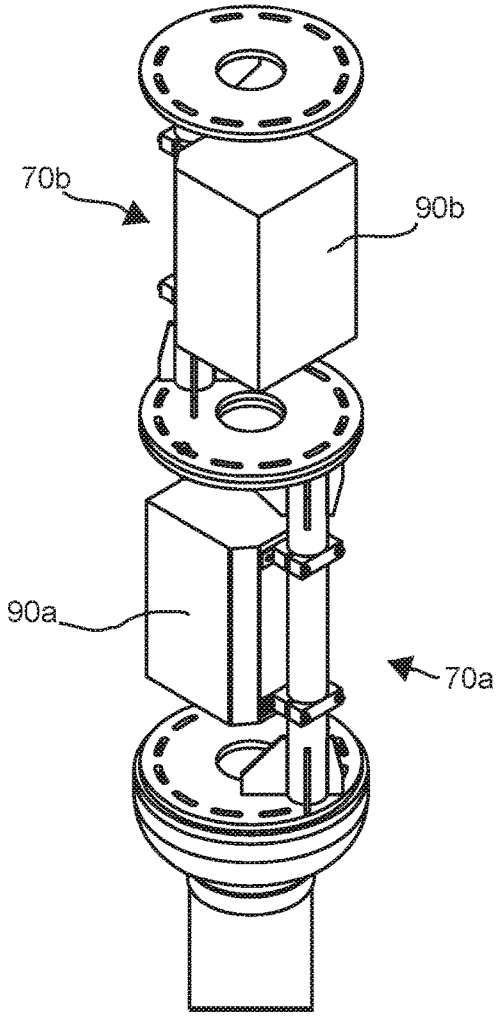

Though discussed above in relation to maintaining antenna sections within the spatial envelope of a supporting pole, it will be appreciated that aspects of the present disclosure have other applications. For instance, the individual antenna support sections may be utilized to provide a small cell pole that has an antenna structure having a reduced diameter compared to an antenna structure that mounts multiple antennas at a common height. FIG. 5A illustrates a further embodiment of a small cell pole 150 where a monopole section 54 supports an antenna housing 152 having a diameter that is greater than the diameter of the supporting monopole. FIGS. 5B and 5C illustrate the interior of the antenna housing 152. As shown, first and second antenna support sections 70*a* and 70*b* are disposed within the interior of the antenna housing 152 to stack first and second antennas 90*a* and 90*b* in a vertical orientation. These antenna support section 70 are substantially similar to the antenna support sections discussed above in relation to FIGS. 2B and 3. Though the antenna support sections and antennas are not disposed within a spatial envelope or projection of the monopole 54, it will be appreciated that the overall diameter of the antenna housing 152 is reduced in comparison to an antenna housing that supports multiple antennas at a common height. Though shown with two antenna support sections, it will be appreciated that, due to the modular nature of the support sections, that additional antenna support sections could be added.

Figure 6A:
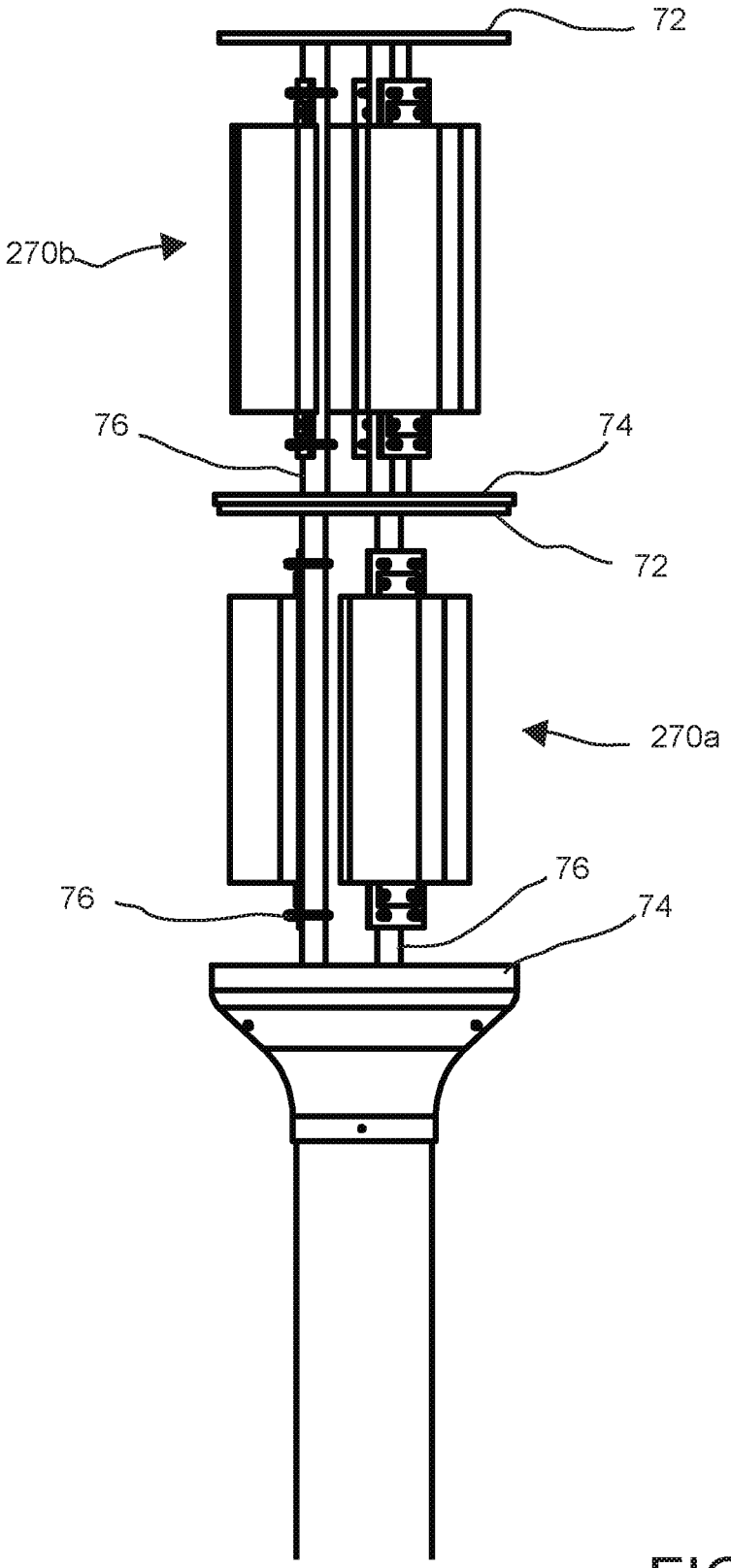
FIGS. 6A and 6B illustrate another embodiment of an antenna section of the small cell pole of FIG. 5A.
Figure 6B:
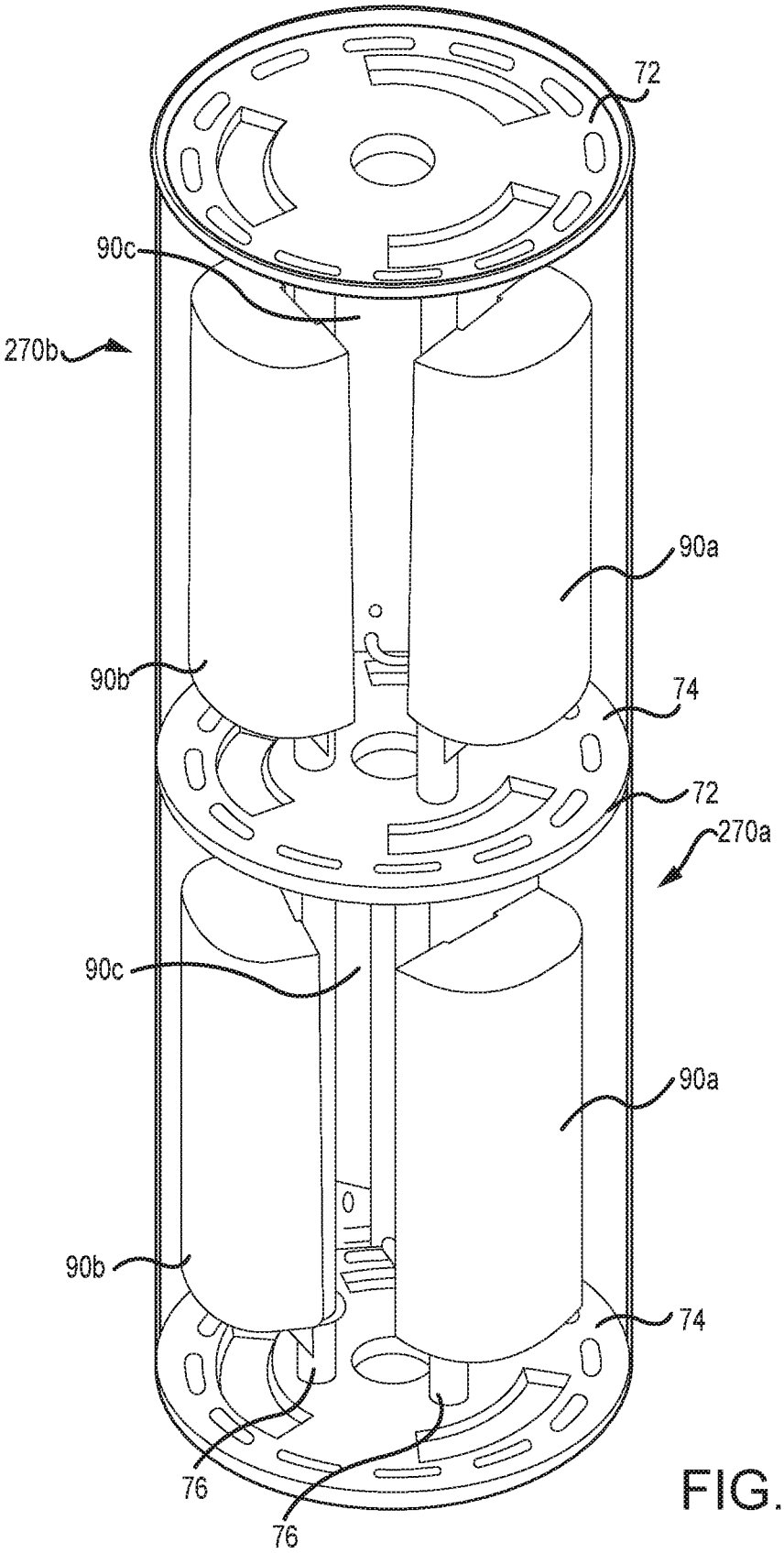

Though primarily discussed in relation to antenna support sections that each support an individual antenna, it will be appreciated that other embodiments may provide antenna support structures that support multiple antennas. FIGS. 6A and 6B illustrate an alternate antenna structure configured to fit within a housing similar to that illustrated in FIG. 5A. As shown, this embodiment illustrates two antenna support sections 270*a* and 270*b* that each support three antennas 90*a*, 90*b* and 90*c*. As with the prior embodiments, this embodiment utilizes first and second spaced plates 74, 72. However, in this embodiment, three struts 76 extend between each pair of plates. Each of the struts supports an individual antenna. As shown, the struts are disposed around the central apertures of the plates. This provides location through which cabling and/or wiring may be routed to facilitate assembly of the antenna structure. This embodiment allows each antenna support section to provide 360 degree coverage using, for example, three 120 degree sector antennas. Of note, the modular configuration would allow two different wireless providers to share a common cell pole. For example, a first wireless provider may utilize the first antenna support structure while a second wireless provider may utilize the second antenna support structure. Likewise, a third wireless provider could use a third antenna support structure. Such an arrangement may allow for reducing the number of cell poles that are requires by multiple wireless providers in a common coverage area.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. An antenna enclosure, comprising:

a pole having a lower end and an upper end, wherein a periphery of the upper end defines a projection above the upper end of the pole about a longitudinal axis of the pole;

a first antenna support section having:

a first upper end;

a first lower end spaced from the first upper end and removably connected to the upper end of the pole; and a first structural support extending between the first upper end and the first lower end, wherein the first structural support is offset from the longitudinal axis of the pole;

a second antenna support section having:

a second upper end;

a second lower end spaced from the second upper end and removably connected to the first upper end of the first antenna support section; and a second structural support extending between the second upper end and the second lower end, wherein the second structural support is offset from the longitudinal axis of the pole; and wherein the first antenna support section and the second antenna support section are disposed within the projection above the upper end of the pole.

2. The antenna enclosure of claim 1, further comprising:

a first antenna disposed within an interior of the first antenna support section between the first upper end and the first lower end;

a second antenna disposed within an interior of the second antenna support section between the second upper end and the second lower end; and wherein the first antenna and the second antenna are disposed within the projection above the upper end of the pole.

3. The antenna enclosure of claim 2, wherein the first antenna support section and the second antenna support section are connected such that the first antenna and the second antenna face in different directions.

4. The antenna enclosure of claim 2 further comprising:

at least one substantially radio frequency transparent cover extending around the first antenna support section and the second antenna support section and extending between the first lower end of the first antenna support section and the second upper end of the second antenna support section.

5. The antenna enclosure of claim 2, wherein the cover has a cross-sectional shape that corresponds to a cross-sectional shape of the upper end of the pole.

6. The antenna enclosure of claim 1, wherein the upper and lower ends of the first antenna support section and the second antenna support section comprise:

annular plates having an open interior.

7. The antenna enclosure of claim 6, wherein each annular plate further comprises a plurality of elongated fastener apertures.

8. The antenna enclosure of claim 1, wherein at least one of the first and second structural supports comprises:

at least one strut, wherein the strut extends substantially parallel to the longitudinal axis of pole.

9. The antenna enclosure of claim 1, wherein at least one of the first and second structural supports comprises:

a peripheral sidewall extending between the upper end and lower end of a corresponding one of the first and second antenna support sections.

10. The antenna enclosure of claim 9, wherein the peripheral sidewall has at least one opening sized to expose an interior of the peripheral sidewall.

11. An antenna enclosure, comprising:

a first antenna support section having:

a first upper end;

a first lower end spaced from the first upper end and removably connected to the upper end of the pole; and a first structural support extending between the first upper end and the first lower end, wherein the first structural support is offset from the longitudinal axis of the antenna support section;

a second antenna support section having:

a second upper end;

a second lower end spaced from the second upper end and removably connected to the first upper end of the first antenna support section; and a second structural support extending between the second upper end and the second lower end, wherein the second structural support is offset from the longitudinal axis of the second antenna support section; and at least one substantially radio frequency transparent cover extending around the first antenna support section and the second antenna support section and extending between the first lower end of the first antenna support section and the second upper end of the second antenna support section.

12. The antenna enclosure of claim 11, wherein the upper and lower ends of the first antenna support section and the second antenna support section comprise: first and second circular plates having an open interior, wherein an area between the first and second annular plates defines an interior of the antenna support section.

13. The antenna enclosure of claim 12, further comprising: a first antenna disposed within the interior of the first antenna support section between the first upper end and the first lower end; a second antenna disposed within the interior of the second antenna support section between the second upper end and the second lower end; and wherein the first antenna and the second antennal are disposed within the cover, wherein the cover is substantially cylindrical.

14. The antenna enclosure of claim 13, wherein the first antenna support section and the second antenna support section are connected such that the first antenna and the second antenna face in different directions.

15. The antenna enclosure of claim 13, wherein each annular plate further comprises a plurality of elongated fastener apertures about a periphery of the annular plate.

16. The antenna enclosure of claim 12, wherein at least one of the first and second structural supports comprises:

at least one strut, wherein the strut extends substantially parallel to the longitudinal axis of the antenna support section.

17. A method for mounting antennas in a pole, comprising:

providing a pole mounted in a generally vertical orientation, the upper end of the pole defining a projection above the upper end of the pole about a longitudinal axis of the pole;

attaching a first antenna support section to the upper end of the pole, wherein the first antenna support section has a generally open interior between a first upper end and a first lower end and a first structural support extending between the first upper end and the first lower end that is offset from the longitudinal axis of the pole;

attaching a second antenna support section to the first upper end of the first antenna support section, wherein the second antenna support section has a generally open interior between a second upper end and a second lower end and a second structural support extending between the second upper end and the second lower end that is offset from the longitudinal axis of the pole, wherein the first antenna support and the second antenna support are disposed within the projection above the upper end of the pole; and covering the first and second antenna support sections with a substantially radio frequency transparent cover.

18. The method of claim 17, further comprising:

mounting a first antenna within the generally open interior of the first antenna support section; and mounting a second antenna within the generally open interior of the second antenna support section, wherein the first and second antennas are disposed within the projection above the upper end of the pole.

* * * * *